US006078236A

United States Patent [19]

Mohler et al.

[11] Patent Number: 6,078,236

[45] **Date of Patent: *Jun. 20, 2000**

[54] ROTARY SOLENOID

[75] Inventors: David Brian Mohler, Tipp City; Philip Edward Fugate, Beavercreek, both of Ohio

[73] Assignee: Lucas Industries plc, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,946

[22] Filed: Oct. 10, 1997

[30] Foreign Application Priority Data

Oct. 12, 1996 [GB] United Kingdom ..... 9621334

[51] Int. Cl.[7] ..... H01F 7/08

[52] U.S. Cl. ..... 335/272; 335/281

[58] Field of Search ..... 335/272, 276, 335/279, 281, 282, 261–2, 224, 225; 310/36, 37, 40 R

[56] References Cited

U.S. PATENT DOCUMENTS

| | | | |
|---|---|---|---|
| 3,548,352 | 12/1979 | Sandoval . | |
| 3,783,312 | 1/1974 | Schindel et al. | 310/36 |
| 3,956,978 | 5/1976 | Borley . | |
| 4,216,849 | 8/1980 | Neill | 188/138 |
| 4,392,423 | 7/1983 | Nakajima et al. | 101/93.48 |
| 4,642,594 | 2/1987 | Volkmar | 335/227 |
| 5,703,555 | 12/1997 | McCann | 335/272 |

FOREIGN PATENT DOCUMENTS

| | | |
|---|---|---|
| 2 951 265 | 4/1971 | France . |
| 2 235 566 | 1/1975 | France . |
| 2 062 356 | 5/1981 | United Kingdom . |

OTHER PUBLICATIONS

JP 03 183347 A, Japanese Patent Abstract, vol. 015, No. 438 (E–1130), Nov. 8, 1991, (Apuritsukusu KK), Aug. 9, 1991.

*Primary Examiner*—Lincoln Donovan
*Attorney, Agent, or Firm*—Andrus, Sceales, Starke & Sawall

[57] ABSTRACT

A rotary solenoid is disclosed which comprises a support member, a U-shaped core secured to the support member such that a limb of the core extends through an opening provided in the support member, a coil encircling part of the core, the coil being carried by the support member, and an armature rotatably mounted upon the support member.

14 Claims, 5 Drawing Sheets

ROTARY SOLENOID

This invention relates to a rotary solenoid which is relatively simple to construct.

Rotary solenoids, for example as described in EP 0073257 and JP 03-183347, generally comprise a U-shaped core around part of which a coil is wound, and an armature mounted adjacent the free ends of the limbs of the core. Upon exciting the coil, a magnetic field is generated which results in movement of the armature towards the ends of the limbs of the core. A spring may be provided to bias the armature away from this position such that when the coil is not excited, the armature is moved to a rest position.

Such rotary solenoids are generally small, and the high number of steps required to assemble such solenoids results in the rotary solenoid being unsuitable for assembly using an automated assembly line.

It is an object of the invention to provide a rotary solenoid of relatively simple construction which may be assembled using an automated assembly process.

According to the present invention there is provided a rotary solenoid comprising a U-shaped core, a support member secured to the core such that a first limb of the core extends through an opening provided in the support member, a coil encircling the first limb of the core and carried by the support member, and an armature rotatably mounted upon the support member.

The support member may include a coil former region upon which the coil is wound. Alternatively the coil may be wound upon a separate former mounted upon the support member.

Conveniently, the support member is provided with an integral projection provided with a re-entrant recess arranged to receive part of the core to secure the support member to the core.

Alternatively, the support member may be secured to the core by means of a retaining clip secured to an end region of the first limb.

A second limb of the core may extend through a respective opening in the support member, and a retaining clip may be secured to an end region of the second limb to secure the support member to the core.

Preferably, the support member includes an upstanding projection arranged to extend through an opening in the armature to rotatably mount the armature upon the support member. A retaining clip may be received by the projection to secure the armature to the projection. Alternatively, the projection may be deformed to prevent or restrict removal of the armature therefrom.

A spring is conveniently engaged between the armature and support member, the spring preferably being arranged to bias the armature towards a position in which the armature engages a stop provided on the support member.

Figure 1:
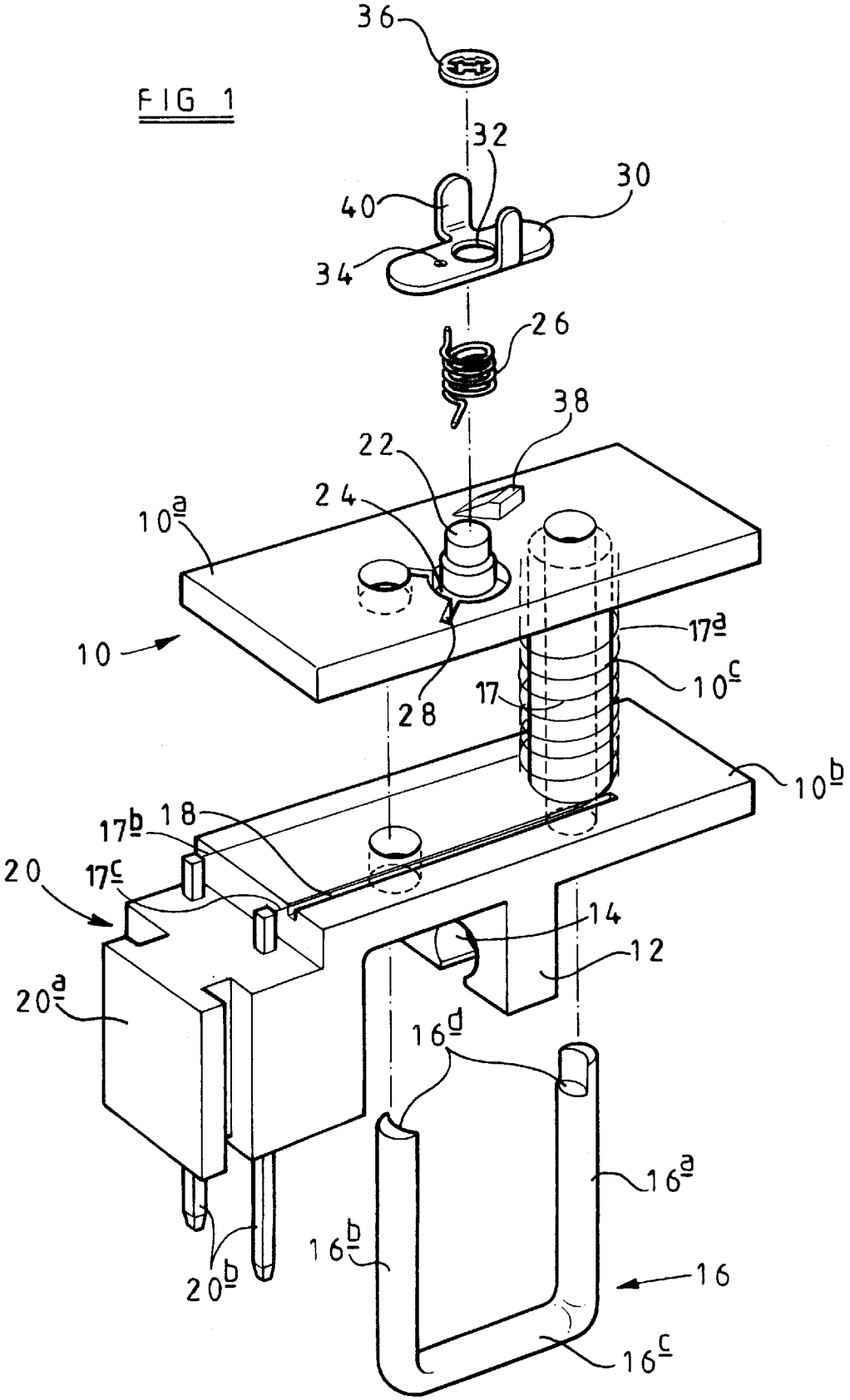
Figure 2:
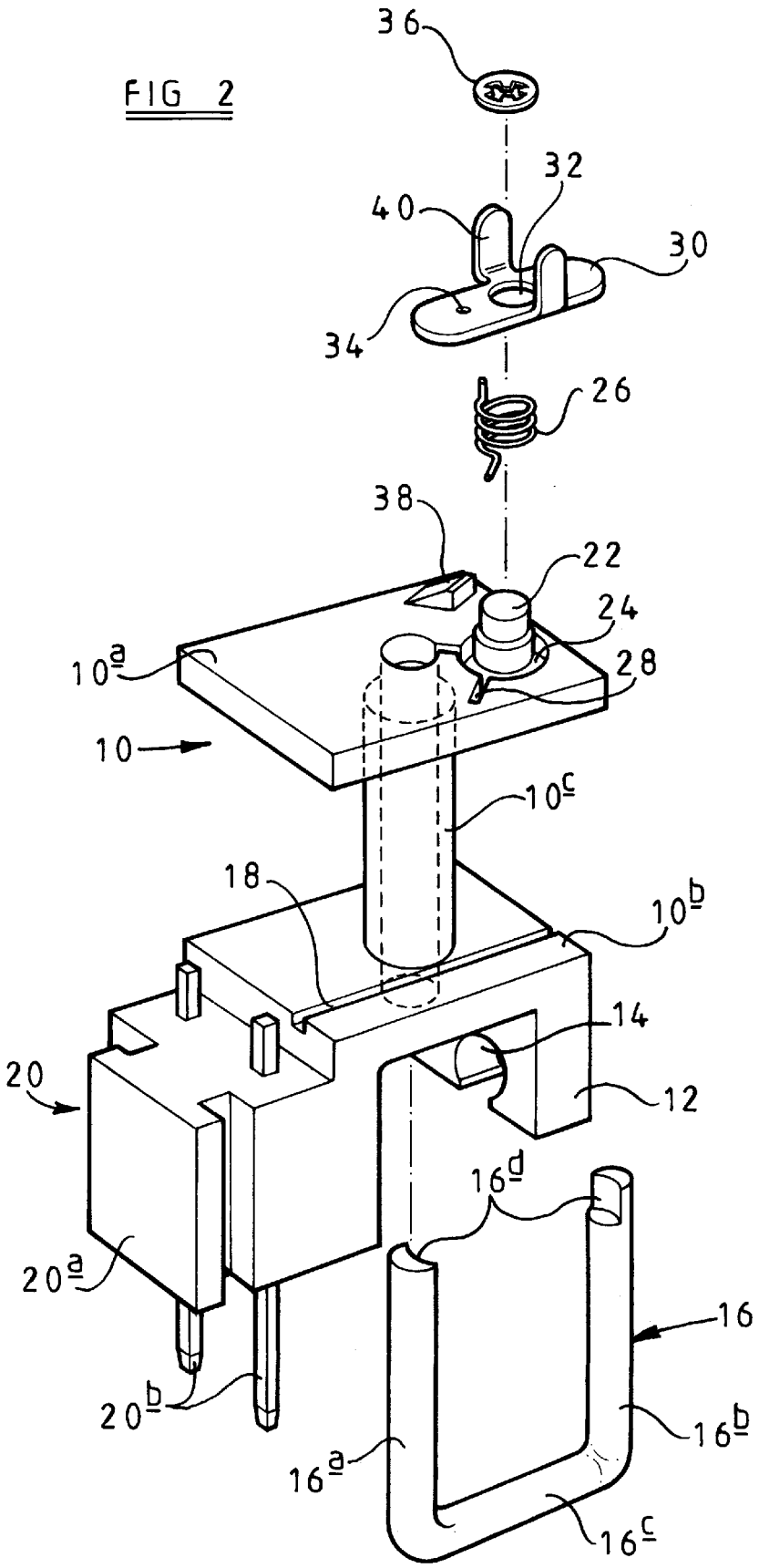
Figure 3:
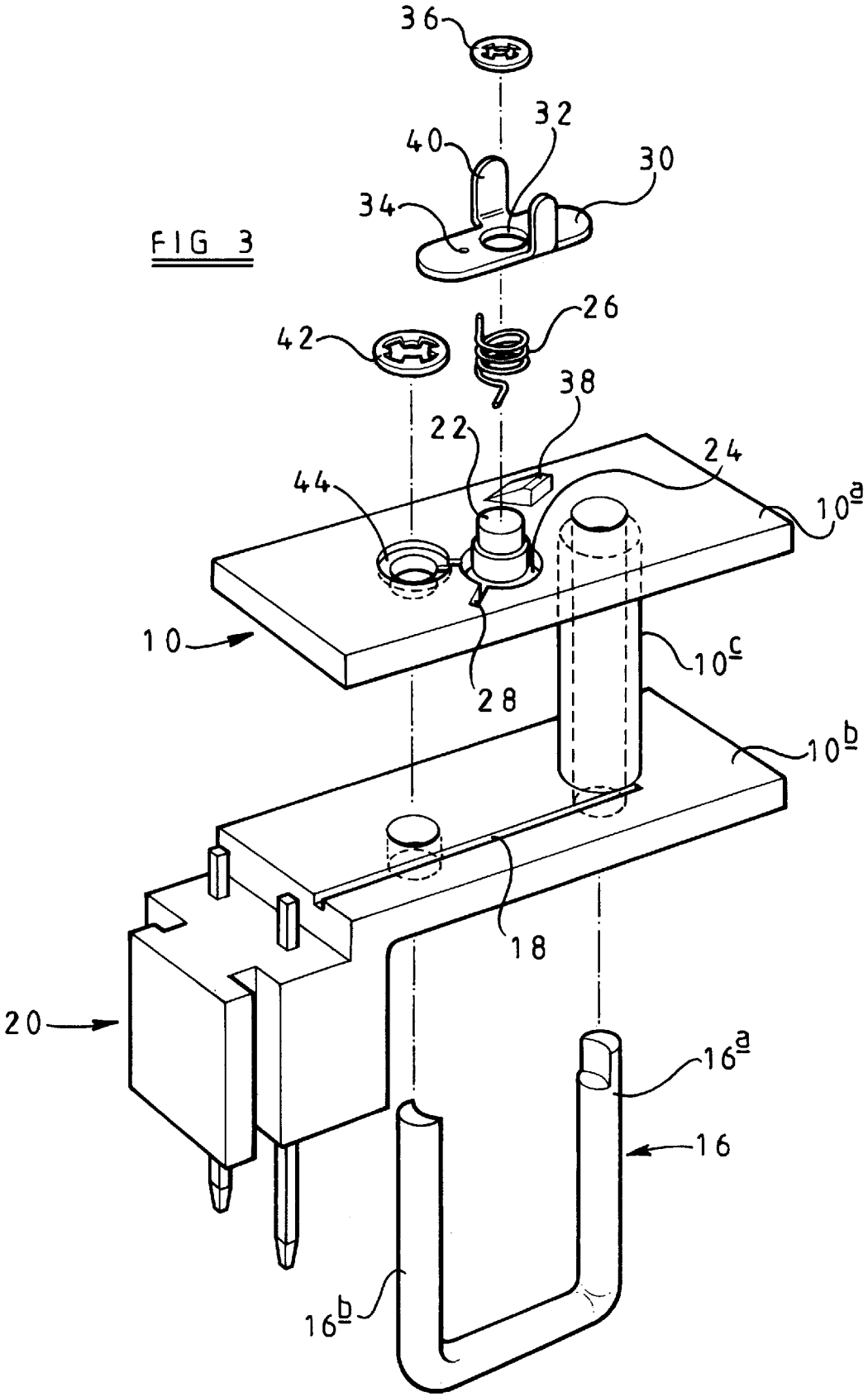
Figures 4, 5:
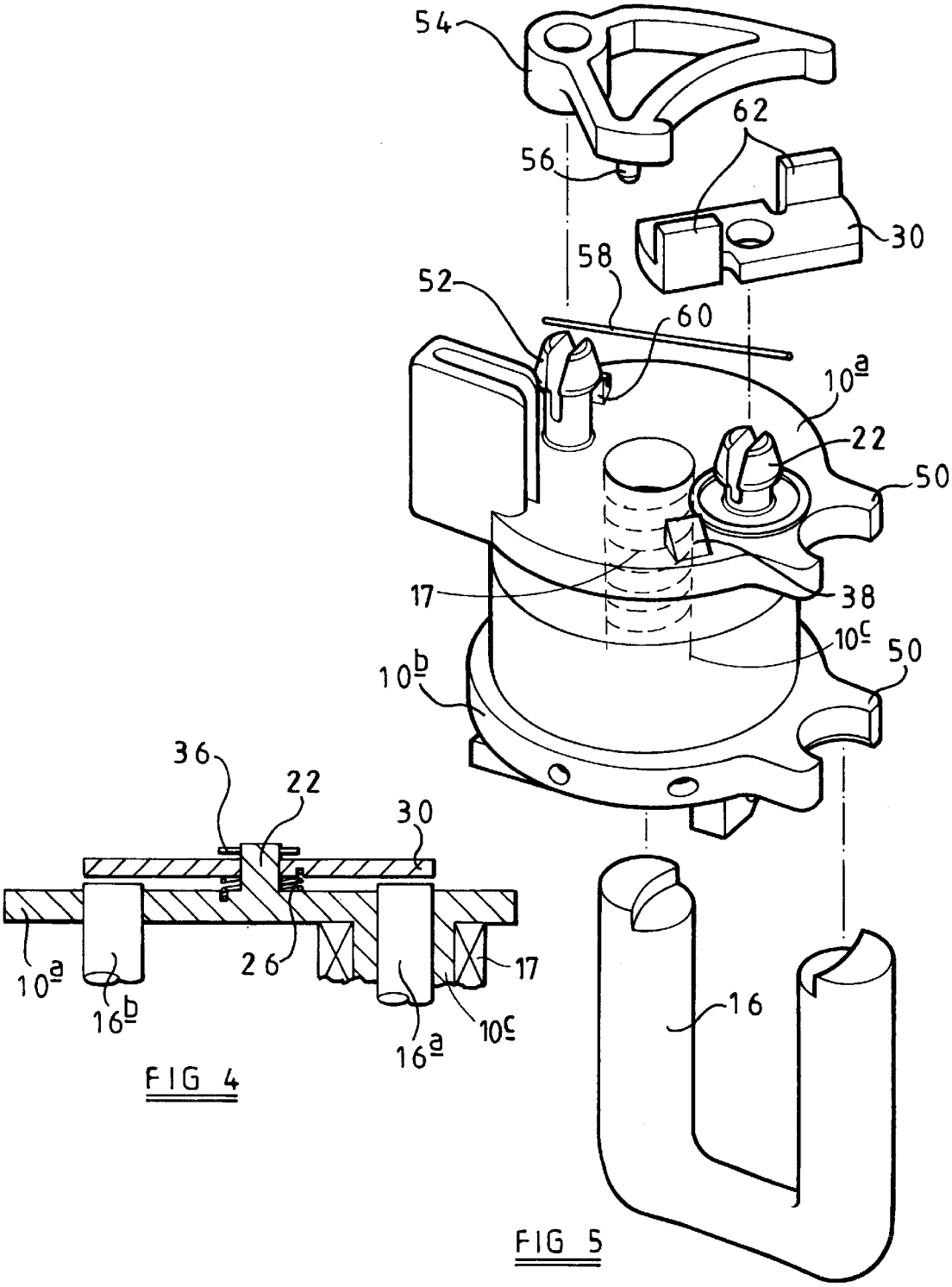
Figure 6:
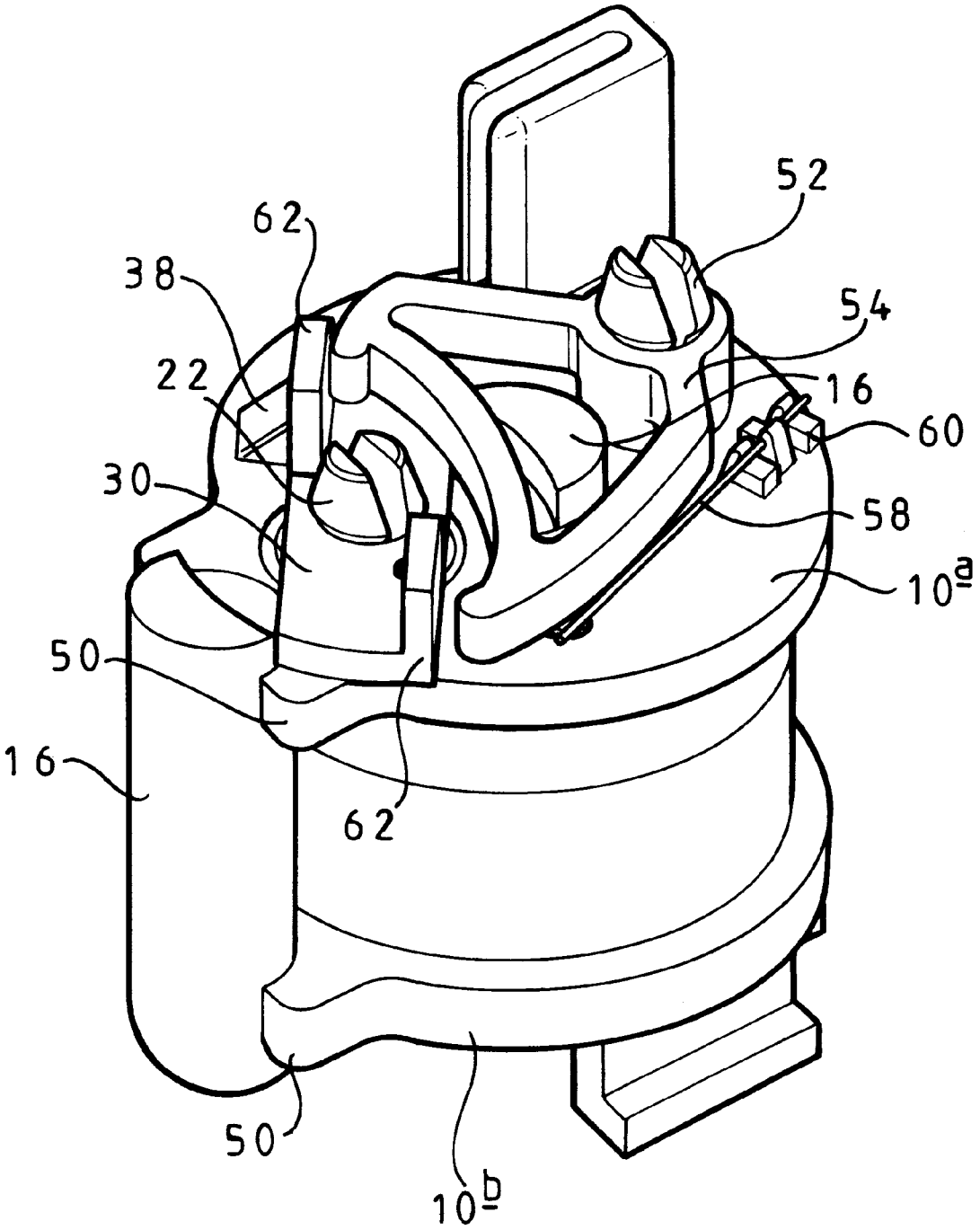

The invention will further be described, by way of example, with reference to the accompanying drawings, in which:

FIGS. 1 to 3 are exploded perspective views of rotary solenoids in accordance with three embodiments of the invention, FIG. 4 is a diagrammatic view of an alternative arrangement, FIG. 5 is an exploded perspective view of a further embodiment, and FIG. 6 is a perspective view of the arrangement of FIG. 5.

The rotary solenoid arrangement illustrated in FIG. 1 comprises a plastics molded support member 10 which includes an upper plate-like part 10*a* integrally connected to a lower plate-like part 10*b* by a tubular region 10*c*. The lower plate-like part 10*b* is provided on its lower surface with a projection 12 including a downwardly facing re-entrant recess or opening 14. The upper and lower plate-like parts 10*a*, 10*b* are both provided with a pair of openings, one of the openings on each of the upper and lower plate-like parts 10*a*, 10*a* being aligned with the tubular part 10*c*.

A core 16 formed from a ferrous rod which is shaped so as to take a generally U-shaped form is arranged so that the limbs 16*a*, 16*b* of the core member 16 extend through the openings of the support member 10. The first limb 16*a* of the core 16 extends through the openings aligned with the tubular part 10*c*, the second limb 10*b* extending through both of the other openings provided in the upper and lower plate-like parts 10*a*, 10*b*. The lower, interconnecting part 16*c* of the core member 16 is received as a snap-fit within the re-entrant recess 14 so as to secure the support member 10 to the core 16. The core 16 may alternatively be of sintered metal or take the form of a U-shaped casting.

A coil 17 is wound around the tubular part 10*c* of the support member 10, and it will be recognised that when the core 16 is secured to the support member 10 as described hereinbefore, the coil indirectly encircles the first limb 16*a* of the core 16. A channel 18 is provided in the upper face of the lower plate-like part 10*b*, the starting end of the coil wire being received within the channel 18. Tubular part 10*c* may also take the form of a bobbin or former 17*a* about which is wound coil 17 as shown in FIG. 1.

A connector arrangement 20 is integral with the lower plate-like part 10*b*, the connector arrangement 20 including a region 20*a* shaped so as to be cooperable with a bracket for supporting the support member 10, in use, terminals 20*b* also being molded into the connector arrangement 20, the terminals 20*b* being soldered to respective ends 17*b*, 17*c* of the wire forming the coil.

The upper face of the upper plate-like part 10*a* is provided with a cylindrical projection 22 located centrally between the two openings of the upper plate-like part 10*a*. An annular recess 24 is provided in the upper face of the upper plate-like part 10*a* surrounding the projection 22. A spring 26 is received within the annular recess 24, an end of the spring 26 being received within a radially outwardly extending groove 28 extending from the annular recess 24. A ferrous armature 30 is rotatably mounted on the projection 22, the armature 30 including a central opening 32 through which the projection 22 extends. The armature 30 is further provided with a small opening 34 arranged to receive a second end of the spring 26. The armature 30 is secured to the projection 22 by means of a "spire washer" retaining clip 36 which is forced onto the projection 22 after the spring 26 and armature 30 have been correctly positioned. The positioning of the spring 26 and armature 30 is such that the armature 30 is biased towards a position in which an end thereof engages a stop 38 provided on the upper face of the upper plate-like part 10*a*.

If necessary, suitable bearings may be provided to aid rotary movement of the armature 30, and the axial length of the opening in the armature 30 may be increased by incorporating a suitable bush to aid guidance of rotary motion.

In order to reduce the air gap between the armature 30 and the limbs 16*a*, 16*b* of the core 16, whilst not restricting rotational movement of the armature 30, the ends of the limbs 16*a*, 16*b* are provided with part circular recesses 16*d*.

In use, when the coil 17 is not excited due to there being no voltage applied to the terminals 20*b*, the armature 30 occupies a position in which an end thereof engages the stop 38 due to the action of the spring 26. Upon exciting the coil 17 the magnetic field due to the excitation of the coil attracts the armature 30, rotating the armature 30 towards a position in which the ends thereof lie adjacent the ends of the limbs 16*a*, 16*b* of the core, the ends of the armature 30 being located within the part-circular recesses 16*d*. Upon de-energising the coil 17 the armature 30 returns to its initial position under the action of the spring 26.

In order to enable motion of the armature 30 to be transmitted to an associated auxiliary device, the armature 30 is provided with lugs 40 which, in use, engage appropriate parts of the associated auxiliary device.

The rotary solenoid illustrated in FIG. 1 lends itself to automated assembly since once the coil 17 has been wound on the tubular part 10*c* of the support member 10 and the ends 17*b*, 17*c* of the wire forming the coil have been soldered to the terminals 20*b*, the remainder of the assembly process may be undertaken in a single assembly location. To assemble the rotary solenoid, the core 16 is mounted in an appropriate jig, and the support member 10 is located over the limbs 16*a*, 16*b* of the core 16, the support member 10 being lowered until the intermediate part 16*c* of the core 16 is received within the re-entrant recess 14, securing the support member 10 to the core 16. Next, the spring 26 is positioned around the projection 22 and received within the recess 24, an end of the spring 26 being received within the groove 28. The armature 30 and retaining clip 36 are then positioned on the projection 22. During each of these assembly steps, the core 16 is held within the jig, movement of the core 16 not being necessary.

It will be recognised, therefore, that the rotary solenoid is of relatively simple construction, assembly of the rotary solenoid being relatively simple, and being suitable for use in an automated assembly arrangement.

FIG. 2 illustrates an arrangement which is similar to that of FIG. 1, but in which the upper and lower plate-like parts 10*a*, 10*b* are of reduced length and only include apertures arranged to receive one of the limbs of the core 16. The integral tubular part 10*c* interconnects the remaining one aperture in each of the upper and lower plate-like parts 10*a*, 10*b*.

The method of assembly, and the operation of the rotary solenoid of FIG. 2 are as described in FIG. 1. The arrangement of FIG. 2 has the advantage that the amount of material used in producing the support member 10 is reduced, but there may be the disadvantage that only one of the limbs of the core 16 is supported, thus the core may be susceptible to damage resulting in the separation of the limbs changing which may result in inefficient operation of the solenoid, or in the armature 30 engaging and possibly becoming trapped between, the limbs of the core 16.

In a modification, one of the upper and lower plate-like parts may be extended so as to guide both limbs of the core, the other of the plate-like parts only receiving one of the limbs.

FIG. 3 illustrates another arrangement which is similar to that of FIG. 1 but in which the projection 12 is not provided on the lower surface of the lower plate-like part 10*b*. Instead, in order to secure the core 16 to the support member 10, after the core 16 has been positioned correctly with respect to the support member 10, a retaining clip 42 is pushed over the end of the second limb 16*b*, the retaining clip 42 being received within a recess 44 provided in the upper surface of the upper plate-like part 10*a* and surrounding the opening thereof through which the second limb 16*b* extends. In other respects, the arrangement of FIG. 3 is identical to that of FIG. 1, and it will be recognised that the assembly of the rotary solenoid of FIG. 3 is similar to that of the solenoid of FIG. 1, the assembly process including the additional step of locating the retaining clip 42 on the second limb 16*b* of the core 16 in order to secure the core 16 to the support member 10.

It will be recognised that the arrangement of FIG. 3 may be modified by arranging for the clip 42 to be positioned on the first limb 16*a* of the core 16, a suitable recess being provided in the upper face of the upper plate-like part 10*a* in order to receive the clip 42, and if desired, a pair of such retaining clips may be used, one clip engaging each of the limbs of the core 16.

In each of the arrangements described hereinbefore, a radially extending air gap exists between the armature 30 and the ends of the limbs 16*a*, 16*b* of the core 16 when the coil 17 is excited and the armature 30 moved so as to lie adjacent the ends of the core 16. It will be appreciated, however, that rather than using an arrangement in which a radial air gap exists, the air gap may extend in a direction substantially parallel to the axis of rotation of the armature 30 as illustrated in FIG. 4, and the modification illustrated in FIG. 4 may be applied to any of the embodiments illustrated in FIGS. 1 to 3 or variations thereof.

FIGS. 5 and 6 illustrate an embodiment in which the plate-like parts 10*a*, 10*b* are of generally circular form and are interconnected by the tubular part 10*c* (in phantom lines) which extends along the axis of the plate-like parts 10*a*, 10*b*. A coil 17 (in phantom lines) is wound around the tubular part 10*c*.

One limb of the core 16 extends through the tubular part, the other limb being received by formations 50 provided on the plate-like parts 10*a*, 10*b*. The core 16 is secured in position by a projection including a re-entrant opening which is formed on the lower surface of the lower plate-like part 10*b* as described hereinbefore.

The upper plate-like part 10*a* is provided with a projection 22 which is shaped to permit mounting of an armature 30 thereon in a snap-fit manner. A further similar projection 52 is provided on the upper plate-like part 10*a* and is used to mount a cam member 54 to the upper plate-like part 10*a*. The cam member 54 includes a downwardly extending peg 56 which, in use, engages a spring 58 secured to the upper plate-like part 10*a* by formations 60 to bias the cam member 54 towards a rest position (illustrated in FIG. 6). The spring 58 may comprise a length of spring wire or flat strip.

The armature 30 includes upwardly extending rotationally symmetrical abutments 62, one of which engages the cam member 54 such that when the cam member 54 occupies its rest position, the armature 30 is pushed by the cam member 54 into engagement with a movement limiting stop 38 provided on the upper plate-like part 10*a*. Energization of the coil 17 causes movement of the armature 30 which, in turn, moves the cam member 54 against the action of the spring 58. The cam member 54 is shaped to amplify the relatively small movement of the armature 30 between its rest and energized positions.

The arrangement of FIGS. 5 and 6 may be modified to include, for example, an axial rather than radial air gap as described with reference to FIG. 4, and other modifications may be made to the device.

In alternative arrangements, the core may be secured to the support member using suitable adhesives or may be an interference fit with the support member. Further, rotational movement of the support member with respect to the core may be restricted by forming the core from a ferrous rod or bar of non-circular cross-section, the openings provided in the support member being similarly shaped.

We claim:

1. A rotary solenoid comprising a U-shaped core having a first limb and a second limb, a support member formed of first and second parallel planar members, secured to the core and having an opening arranged such that the first limb of the core extends through the opening provided in the support member, a coil indirectly encircling the first limb of the core and carried by and sandwiched between the first and second planar members of the support member, an armature rotatably mounted upon and in parallel with one of the planar support members of the support member and a stop secured to the support member, the armature being spring biased towards the stop.

2. A rotary solenoid as claimed in claim 1, wherein the support member includes an integral coil former region upon which the coil is wound.

3. A rotary solenoid as claimed in claim 1, further comprising a coil former upon which the coil is wound, the coil former being mounted, in use, upon the support member.

4. A rotary solenoid as claimed in claim 1, wherein the support member includes an integral projection having a re-entrant recess arranged to receive part of the core to secure the core to the support member.

5. A rotary solenoid as claimed in claim 1, wherein the core is arranged to receive a retaining clip to secure the core to the support member.

6. A rotary solenoid as claimed in claim 1, wherein the support member further includes an upstanding projection arranged to extend through an opening formed in the armature to rotatably mount the armature to the support member.

7. A rotary solenoid as claimed in claim 6, wherein the projection is arranged to receive the armature in a snap-fit manner.

8. A rotary solenoid as claimed in claim 6, further comprising a retaining clip locatable on the projection to secure the armature to the projection.

9. A rotary solenoid as claimed in claim 6, wherein the projection is arranged to be deformed to prevent or restrict removal of the armature.

10. A rotary solenoid as claimed in claim 1, wherein the spring means is engaged between the armature and the support member.

11. A rotary solenoid as claimed in claim 1, further comprising a cam member arranged to engage the armature such that movement of the armature causes angular movement of the cam member.

12. A rotary solenoid as claimed in claim 11, further comprising spring means biasing the cam member towards a rest position in which the armature engages a stop.

13. A rotary solenoid as claimed in claim 1, further comprising electrical terminals electrically connected to the coil and arranged to provide electrical and mechanical connections between the rotary solenoid and a support.

14. A method of assembling a rotary solenoid, the method comprising the steps of:

providing a U-shaped core having a first limb and a second limb;

providing a support member, formed of first and second parallel planar members, having an opening formed therein, a stop mounted thereon, and a coil carried thereby;

securing the support member to the core such that the first limb of the core extends through the opening in the support member and is indirectly encircled by the coil;

rotatably mounting an armature on the support member; and spring biasing the armature for rotational motion in a plane parallel to one of the first or second planar members toward the stop of the support member.

* * * * *